United States Patent [19]

Maloney

[11] 4,121,129

[45] Oct. 17, 1978

[54] DISPLAY PANEL AND METHOD OF MANUFACTURE THEREOF

[75] Inventor: Thomas C. Maloney, Bernardsville, N.J.

[73] Assignee: Burroughs Corporation, Detroit, Mich.

[21] Appl. No.: 800,048

[22] Filed: May 24, 1977

[51] Int. Cl.[2] ..... H01J 61/30

[52] U.S. Cl. ..... 313/221; 313/220

[58] Field of Search ..... 313/221, 220

[56] References Cited

U.S. PATENT DOCUMENTS 3,573,531 4/1971 Kerstetter et al. ..... 313/221 X

*Primary Examiner*—Rudolph V. Rolinec
*Assistant Examiner*—Darwin R. Hostetter
*Attorney, Agent, or Firm*—Kevin R. Peterson; Robert A. Green; Edward J. Feeney, Jr.

[57] ABSTRACT

The disclosure is of a display panel which includes a gas-filled envelope which contains cathodes and anodes spaced apart from each other and formed into rows and columns of dotlike cells by an insulating cell sheet. The insulating sheet is of a glassy material and is coated with an opaque, slightly reflective, resistive material such as silicon. The coating provides good display contrast by hiding the cathode glow of the priming cathodes in the panel.

2 Claims, 2 Drawing Figures

DISPLAY PANEL AND METHOD OF MANUFACTURE THEREOF

BACKGROUND OF THE INVENTION

The present invention relates to display panels of the type known as SELF-SCAN panels. Panels of this type are shown in U.S. Pat. No. 3,989,981 and 3,995,185, which are incorporated herein by reference. These panels include between the base plate and face plate a cell sheet made of Fotoform glass which is a photosensitive glass which is described in U.S. Pat. Nos. 2,971,853, 2,684,911, and 2,628,160. Briefly, Fotoform sheets are made by preparing a particular glass composition in the desired shape and processing to form a clear sheet which is photosensitive. The sheet is photographically exposed and etched to provide cells or slots, as required, and then it is further processed to render it opaque, a requirement for some display devices. It has been observed that Fotoform cell sheets thus processed do not have uniform thickness and the top and bottom surfaces are not uniformly spaced apart throughout the area of the sheet. Such dimensional nonuniformity is detrimental to proper construction and operation of display panels, especially display panels known as SELF-SCAN II panels.

The present invention provides a display panel having a cell sheet which is opaque, has dimensional uniformity, and is relatively inexpensive and easy to manufacture. Briefly, the invention comprises preparing a plate of photosensitive insulating material and photographically exposing and etching to form a plate having the desired pattern of openings. The plate thus formed is not processed to its opaque state, but rather, it is coated with silicon to form a thin coating which is opaque and highly resistive, as desired.

DESCRIPTION OF THE PREFERRED EMBODIMENTS

Figure 1:
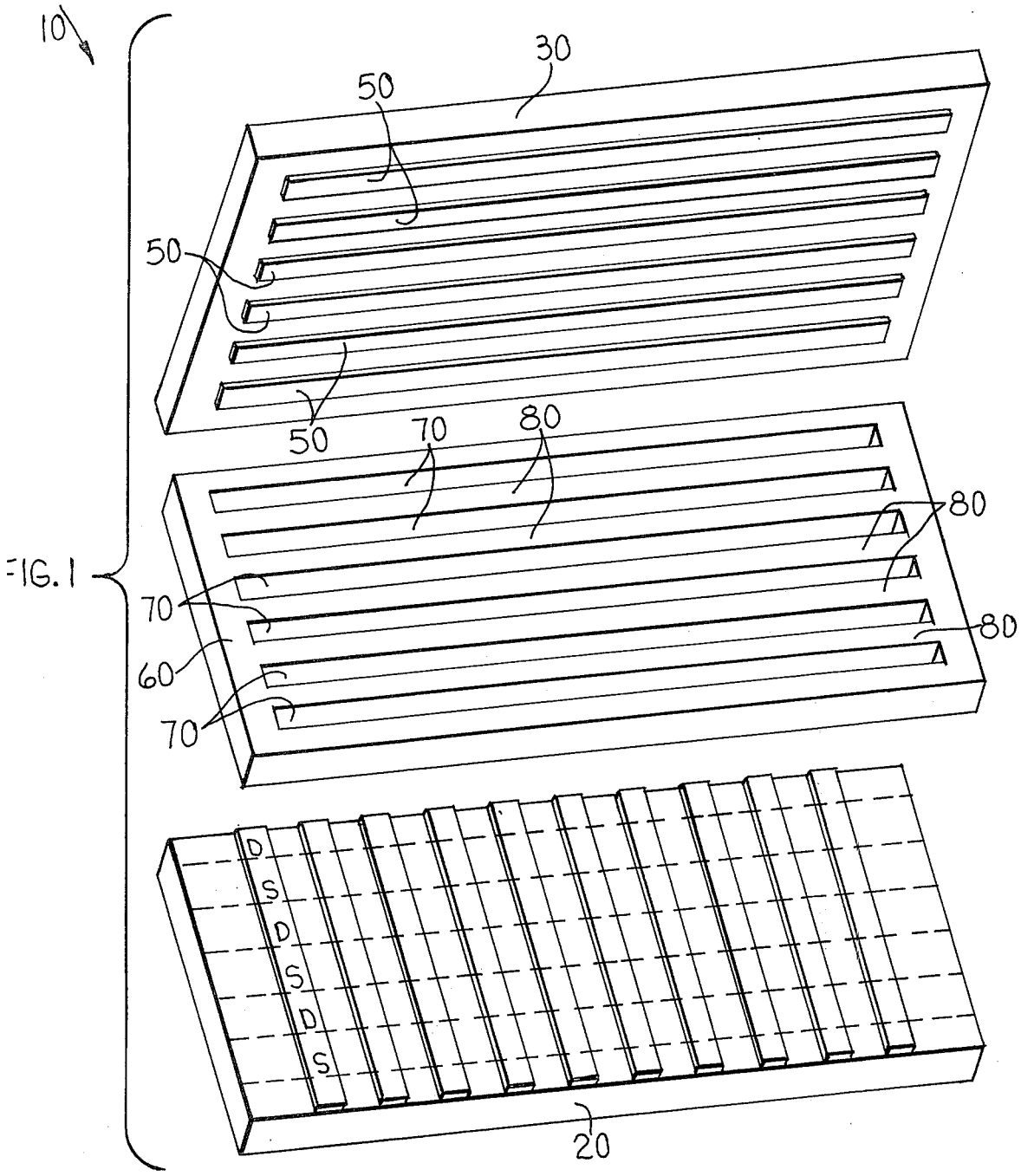
FIG. 1 is a perspective exploded view of a display panel embodying the invention.
Figure 2:
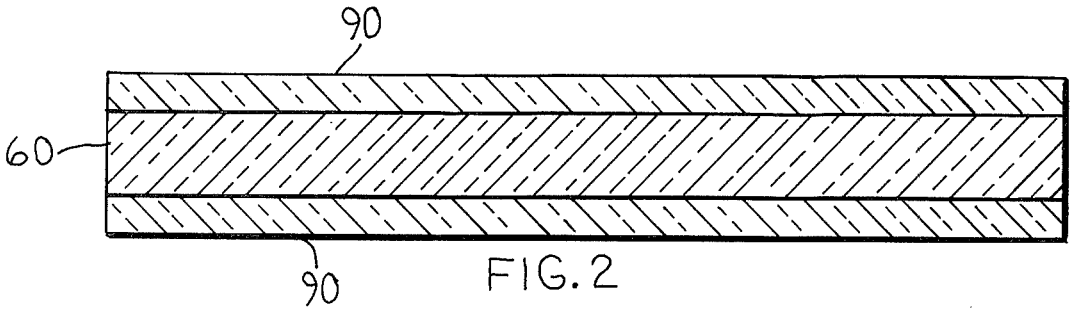
FIG. 2 is a sectional view of the center sheet of the panel of FIG. 1.

A display panel 10 embodying the invention comprises an envelope made up of a base plate 20 and face plate 30 hermetically sealed together and filled with an ionizable gas such as neon, xenon, argon, either singly or in suitable combination. Mercury vapor is also provided to minimize cathode sputtering.

The panel 10 includes a plurality of vertical cathode strips 40 on the top surface of the base plate and a plurality of narrow horizontal transparent conductive anodes 50 on the inner surface of the face plate. Each anode is aligned with a row of the slots in the cell sheet and the rows of cathode elements to be described.

The panel also includes an insulating center sheet 60 disposed between the base plate and face plate. The sheet has a plurality of horizontal slots 70 defined by ribs 80 and is seated on the cathode strip so that it, in effect, divides the surfaces of the cathodes into individual operating areas D and S. Thus, the horizontal slots define parallel rows of cathode areas or cathodes. Each cathode area and the portion of the anode above it and the gas between them define a gas cell. The subdividing effect on the cathodes of the ribs 80 of the center sheet 60 is illustrated by the dash lines in FIG. 1.

According to the invention, the center sheet or cell sheet 60 is prepared as follows. A mixture of glasses described in the above-identified patents and including, for example, $SiO_2$, $Li_2C$, $Na_2O$, $K_2O$, $Al_2O_3$, ZnO, $CeO_2$, Au, AgCl, is melted and shaped into a flat sheet by any suitable process. The sheet thus formed is clear, unopacified, is in the amorphous state, and is photosensitive. This sheet is exposed through a suitable photographic master, and it is etched to form the desired slots or channels. At this time, the glass plate is clear and transparent to light. Next, the sheet is coated on all of its surfaces, especially on its top surface and in the channels, with a layer 90 of a material which is opaque and highly electrically resistive.

One suitable coating material is silicon which is deposited on the sheet 60 by a sputtering process or by other processes such as spraying, evaporation, vapor deposition, or the like. The silicon film or layer has all of the characteristics desired, and it does not adversely affect the dimensional uniformity of the sheet 60 itself.

It will be clear to those skilled in the art that the principles of the invention may be utilized to coat portions of the cell sheet and other portions of a display panel other than the cell sheet.

What is claimed is:

1. A display panel including a gas-filled envelope having a base plate and a face plate hermetically sealed together, said face plate having a viewing window, a plurality of parallel cathode strips disposed generally vertically on the top surface of said base plate, a plurality of horizontal anode strips on the inner surface of said face plate, said anode strips overlying said cathode strips, each crossing of an anode strip and a cathode strip defining a glow discharge cell, and an insulating plate having a bottom surface and a top surface and a plurality of parallel channels therein, said plate being seated on said base plate so that said channels define rows of elemental cathode portions of said cathode strips, each channel being aligned with an anode strip, each row of elemental cathode portions being aligned with an anode strip and operable therewith, cathode glow being visible to a viewer through an anode strip and a channel, said insulating plate being coated, on said top and bottom surfaces and on the walls of said channels, with an opaque material so that cathode glow cannot be seen by a viewer other than when viewed directly through an anode and a channel in said insulating plate.

2. The panel defined in claim 1 wherein said opaque coating includes silicon.

* * * * *